US007438253B2

(12) United States Patent
Schunck

(10) Patent No.: US 7,438,253 B2
(45) Date of Patent: Oct. 21, 2008

(54) SPOOL SUPPORT SYSTEM

(76) Inventor: Robert John Schunck, 711 41st Ave., NE., St., St. Petersburg, FL (US) 33703

( * ) Notice: Subject to any disclaimer, the term of this patent is extended or adjusted under 35 U.S.C. 154(b) by 0 days.

(21) Appl. No.: 11/601,078

(22) Filed: Nov. 17, 2006

(65) Prior Publication Data

US 2008/0115708 A1 May 22, 2008

(51) Int. Cl.
*B65H 57/18* (2006.01)
*B65H 49/26* (2006.01)

(52) U.S. Cl. ..... 242/566; 242/597.4; 242/140

(58) Field of Classification Search ..... 242/597.4, 242/129.7, 129.71, 129.72, 566, 128, 590, 242/593, 597, 597.1, 597.6, 597.7, 129.5, 242/130, 130.1, 134, 139, 140, 364.5; 112/302, 112/258, 259; 223/106, 108
See application file for complete search history.

(56) References Cited

U.S. PATENT DOCUMENTS 2,552,086 A * 5/1951 Bugg ..... 242/128
3,122,113 A * 2/1964 Edwards ..... 112/302
3,309,040 A 3/1967 Stancil
3,381,641 A * 5/1968 Bialy et al. ..... 112/302
4,271,687 A * 6/1981 Memminger et al. ..... 66/146
5,285,740 A 2/1994 Yanagi
5,694,873 A * 12/1997 Wu ..... 112/302
5,913,485 A 6/1999 Buffett
6,729,252 B2 * 5/2004 Wada et al. ..... 112/278

* cited by examiner

*Primary Examiner*—Peter M. Cuomo
*Assistant Examiner*—William E Dondero

(57) ABSTRACT

A base of a spool support system has a central extent with a first leg and a second leg. A cylindrical rod is secured to the second leg and has a free end facing toward the first leg. A spool retention component supported on the rod has an interior end adapted to contact the spool. A cylindrical aperture in the first leg is axially aligned with the rod and is adapted to receive and guide thread fed to a sewing machine from a spool. A guide rod fabricated of a relatively stiff material has a looped end and a short bent end. A short recess extends laterally into the base frictionally supporting the short bent end of the guide rod.

5 Claims, 4 Drawing Sheets

SPOOL SUPPORT SYSTEM

BACKGROUND OF THE INVENTION

1. Field of the Invention

The present invention relates to a spool support system and more particularly pertains to retaining any of a plurality of spools of thread and selectively feeding a thread from a preselected spool to a sewing machine in operative proximity to the system.

2. Description of the Prior Art

The use of spool supports is known in the prior art. More specifically, spool supports previously devised and utilized for the purpose of retaining and feeding thread from a spool are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,309,040 issued Mar. 14, 1967 to Stancil relates to a Reversible Spool Unit for Knitting Yarn. U.S. Pat. No. 5,285,740 issued Feb. 15, 1994 to Yanagi relates to a Horizontal Spool Pin Supporting Device for a Sewing Machine. Lastly, U.S. Pat. No. 5,913,485 issued Jun. 22, 1999 to Buffett relates to a Device for Holding a Plurality of Spools of Thread and Feeding a Selected Thread onto an Adjacent Sewing Machine.

While these devices fulfill their respective, particular objectives and requirements, the aforementioned patents do not describe a spool support system that allows retaining any of a plurality of spools of thread and selectively feeding a thread from a preselected spool to a sewing machine in operative proximity to the system.

In this respect, the spool support system according to the present invention substantially departs from the conventional concepts and designs of the prior art, and in doing so provides an apparatus primarily developed for the purpose of retaining any of a plurality of spools of thread and selectively feeding a thread from a preselected spool to a sewing machine in operative proximity to the system.

Therefore, it can be appreciated that there exists a continuing need for a new and improved spool support system which can be used for retaining any of a plurality of spools of thread and selectively feeding a thread from a preselected spool to a sewing machine in operative proximity to the system. In this regard, the present invention substantially fulfills this need.

SUMMARY OF THE INVENTION

In view of the foregoing disadvantages inherent in the known types of spool supports now present in the prior art, the present invention provides an improved spool support system. As such, the general purpose of the present invention, which will be described subsequently in greater detail, is to provide a new and improved spool support system and method which has all the advantages of the prior art and none of the disadvantages.

To attain this, the present invention essentially comprises a spool support system for retaining any of a plurality of spools of thread and selectively feeding a thread from a preselected spool to a sewing machine in operative proximity to the system. First provided is a base. The base is in a generally U-shaped configuration. The base includes a central extent with a planar exterior face and a parallel interior face. The interior face has a first end. A short leg extends perpendicularly from the first end. The interior face also has a second end. A long leg extends perpendicularly from the second end.

The base also includes a first spacer secured to the exterior face adjacent to the first end. The base also includes a second spacer secured to the exterior face adjacent to the second end. The base is fabricated of a rigid plastic material.

Next provided is a cylindrical rod. The cylindrical rod has a fixed end rigidly secured to the long leg and a free end facing toward the short leg. The rod is parallel with the interior face of the central extent. The rod is fabricated of a rigid metal. The rod is of a length of between about 40 and 60 percent of the length of the central extent.

Next provided is a generally cylindrical spool. The spool has an interior cylindrical surface rotatably received on the rod and an exterior cylindrical surface supporting thread thereon. The spool includes free axial ends with an interior flange and an exterior flange at the free axial ends thereof.

Next provided are spool retention components. The spool retention components include a stepped disk fabricated of a lubricious plastic material. The stepped disk has a central aperture adapted to be frictionally supported on the rod. The disk has a stepped interior end adapted to receive the exterior flange of the spool. The stepped interior end of the disk provides a friction abating surface for thread pulled from the spool during operation and use.

Next provided are secondary retention components. The secondary retention components include a cone. The cone has a central cylindrical aperture adapted to be frictionally supported on the rod. The cone also has a cone-shaped exterior surface for receiving a cone shaped spool supporting threads. The secondary retention components also include the stepped disk. The cone-shaped spool on the rod is between the cone exteriorly and the stepped disk interiorly.

Next provided is a tertiary retention component. The tertiary retention component includes a small disk fabricated of a lubricious plastic material. The small disk has a central aperture adapted to be frictionally supported on the rod. A small spool supports thread. The small disc rotatably supports the small spool on the rod.

Next provided is a cylindrical aperture in the short leg axially aligned with the rod. The cylindrical aperture is adapted to receive and guide thread fed to a sewing machine from a spool.

Next provided is a guide rod fabricated of a relatively stiff metal wire. The guide rod has a looped end and a short bent end and an extended length there between. A short recess extends laterally into the base in proximity to the central extent and the short leg. The short recess frictionally supports the short bent end of the guide rod for rotation between a stowed inoperative orientation with the looped end in proximity to the long leg and an extended operative orientation with the looped end remote from the central extent and long leg of the base. The looped end receives and guides a thread from the aperture in the short leg and a sewing machine. The extended length has a bend in a central extent of between about 120 and 150 degrees whereby the system is operable with the exterior face of the base on a recipient surface and in an alternate mode with the long leg on a recipient surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved spool support system which has all of the advantages of the prior art spool supports and none of the disadvantages.

It is another object of the present invention to provide a new and improved spool support system which may be easily and efficiently manufactured and marketed.

It is further object of the present invention to provide a new and improved spool support system which is of durable and reliable constructions.

An even further object of the present invention is to provide a new and improved spool support system which is susceptible of a low cost of manufacture with regard to both materials and labor, and which accordingly is then susceptible of low prices of sale to the consuming public, thereby making such spool support system economically available to the buying public.

Even still another object of the present invention is to provide a spool support system for retaining any of a plurality of spools of thread and selectively feeding a thread from a preselected spool to a sewing machine in operative proximity to the system.

Lastly, it is an object of the present invention to provide a new and improved spool support system having a base with a central extent with a short leg and a long leg, a cylindrical rod secured to the long leg having a free end facing toward the short leg, a spool retention component supported on the rod having an interior end adapted to contact the spool, a cylindrical aperture in the short leg axially aligned with the rod and adapted to receive and guide thread fed to a sewing machine from a spool, a guide rod fabricated of a relatively stiff material having a looped end and a short bent end, and a short recess extending laterally into the base frictionally supporting the short bent end of the guide rod.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
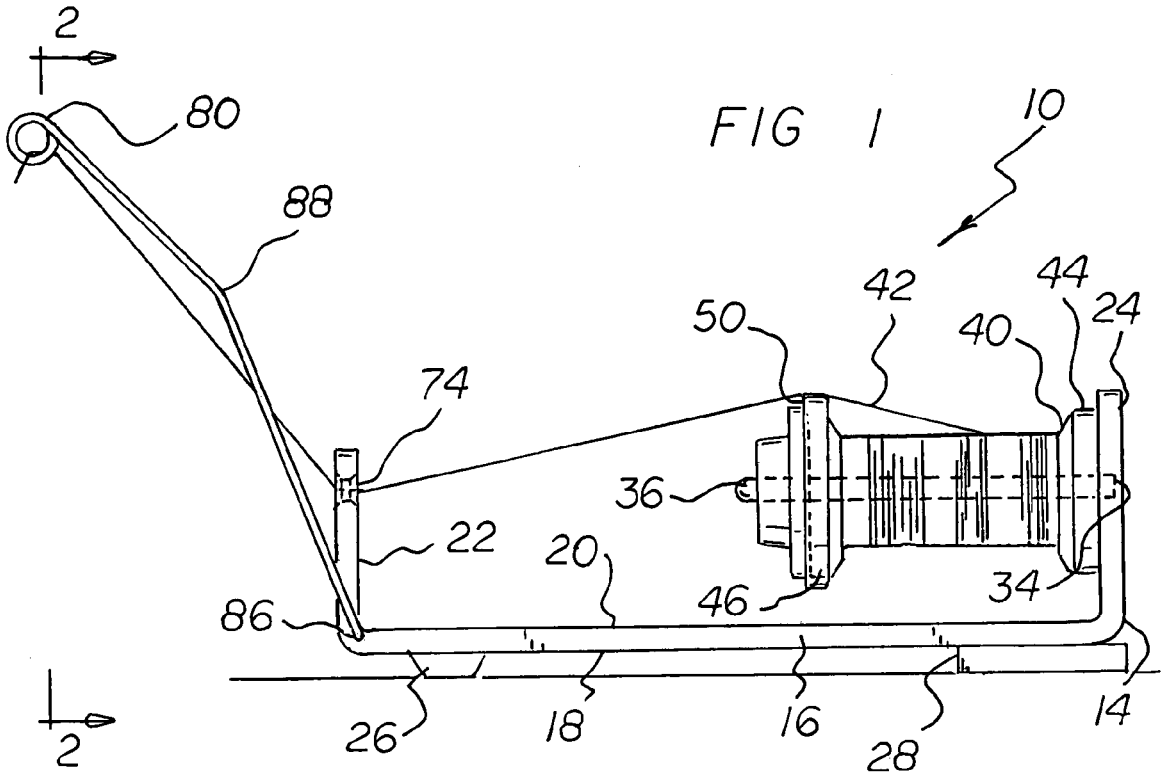
FIG. 1 is a front elevational view of a spool support system constructed in accordance with the primary embodiment of the present invention, the system being deployed for operation and use with the rod and spool horizontally disposed.
Figure 2:
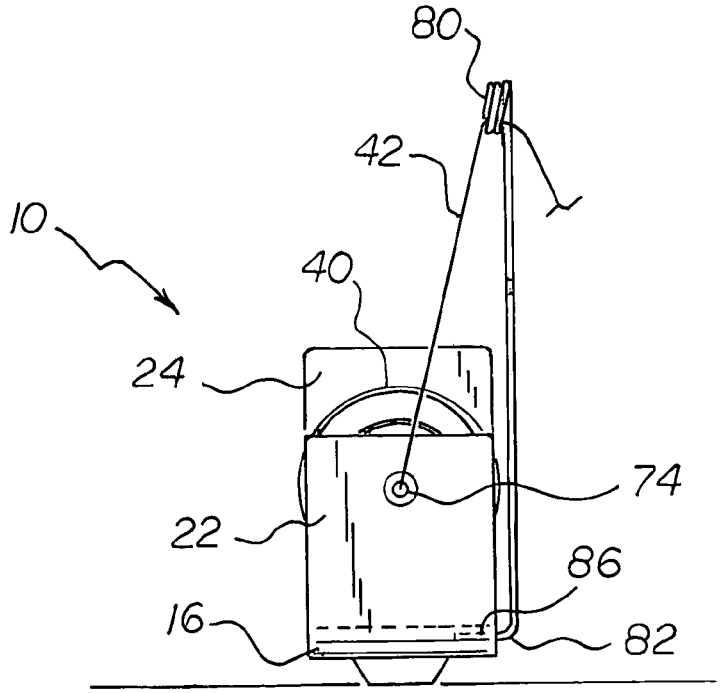
FIG. 2 is an end elevational view of the system taken along line 2-2 of FIG. 1.

With reference now to the drawings, and in particular to FIG. 1 thereof, the preferred embodiment of the new and improved spool support system embodying the principles and concepts of the present invention and generally designated by the reference numeral 10 will be described.

The present invention, the spool support system 10 for retaining any of a plurality of spools of thread and selectively feeding a thread from a preselected spool to a sewing machine in operative proximity to the system is comprised of a plurality of components. Such components in their broadest context include a base with a short leg and a long leg, a cylindrical rod, a spool retention component, a cylindrical aperture in the short leg and a guide rod. Such components are individually configured and correlated with respect to each other so as to attain the desired objective.

First provided is a base 14. The base is in a generally U-shaped configuration. The base includes a central extent 16 with a planar exterior face 18 and a parallel interior face 20. The interior face has a first end. A short leg 22 extends perpendicularly from the first end. The interior face also has a second end. A long leg 24 extends perpendicularly from the second end. The base also includes a first spacer 26 secured to the exterior face adjacent to the first end. The base also includes a second spacer 28 secured to the exterior face adjacent to the second end. The base is fabricated of a rigid material, preferably plastic or, in the alternative, metal.

Next provided is a cylindrical rod 32. The cylindrical rod has a fixed end 34 rigidly secured to the long leg and a free end 36 facing toward the short leg. The rod is parallel with the interior face of the central extent. The rod is fabricated of a rigid metal. The rod is of a length of between about 40 and 60 percent of the length of the central extent.

Next provided is a generally cylindrical spool 40. The spool has an interior cylindrical surface rotatably received on the rod and an exterior cylindrical surface supporting thread 42 thereon. The spool includes free axial ends with an interior flange 44 and an exterior flange 46 at the free axial ends thereof.

Next provided are spool retention components. The spool retention components include a stepped disk 50 fabricated of a lubricious plastic material. The stepped disk has a central aperture 52 adapted to be frictionally supported on the rod. The disk has a stepped interior end 54 adapted to receive the exterior flange of the spool. The stepped interior end of the disk provides a friction abating surface for thread pulled from the spool during operation and use.

Figure 4:
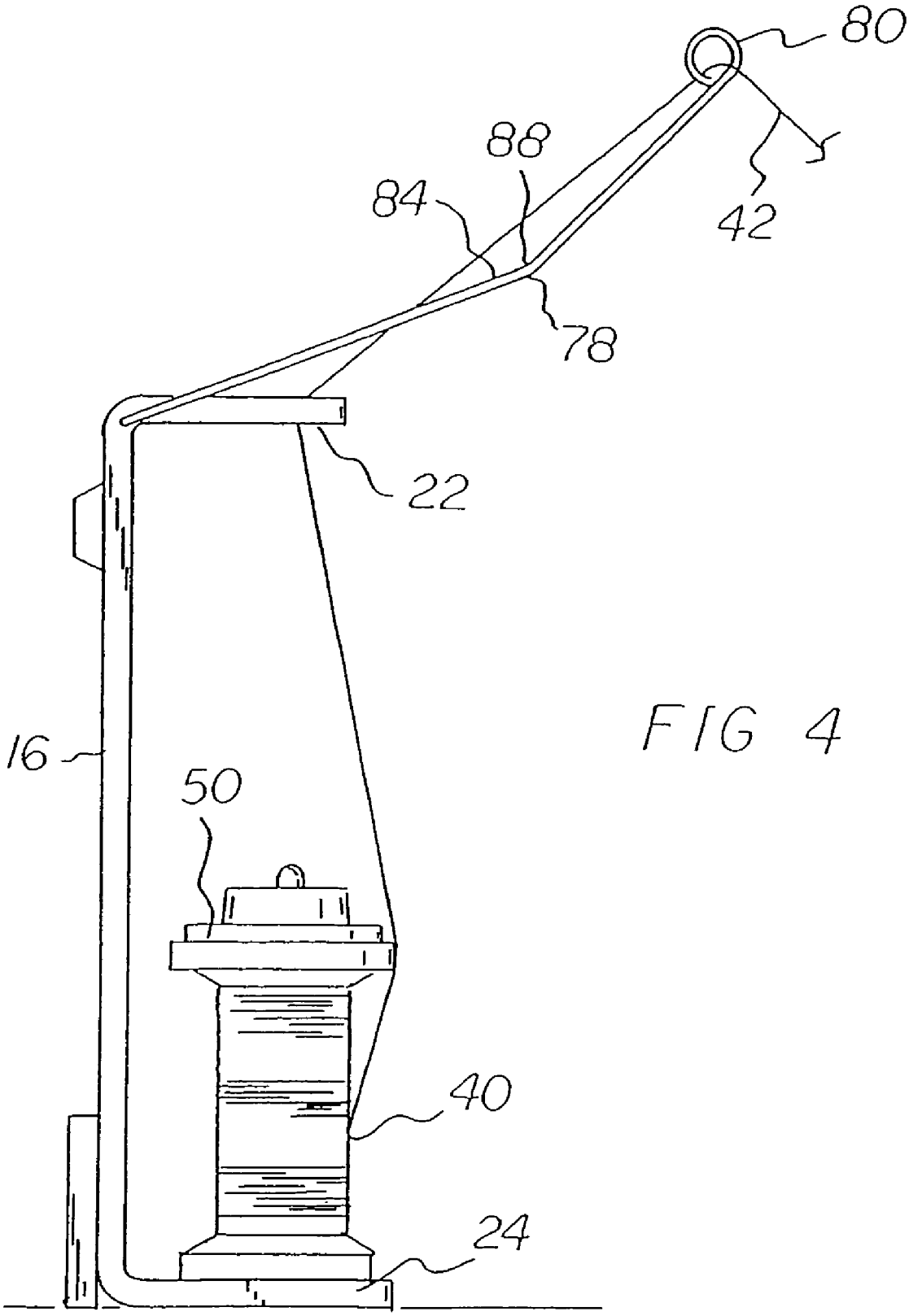
FIG. 4 is a front elevational view similar to FIG. 1 but with the rod and spool vertically disposed.

The primary embodiment is best seen in FIG. 1 with the rod in a horizontal orientation and in FIG. 4 with the rod in a vertical orientation.

Figure 5:
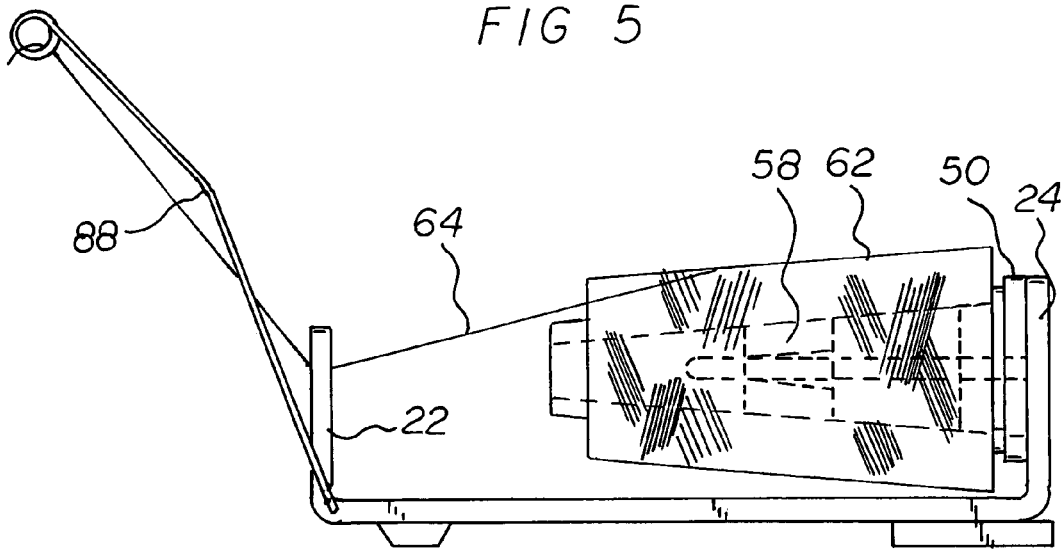
FIG. 5 is a front elevational view of a spool support system similar to FIG. 1 constructed in accordance with another alternate embodiment of the invention, the spool being cone-shaped and with the rod and spool horizontally disposed.
Figure 6:
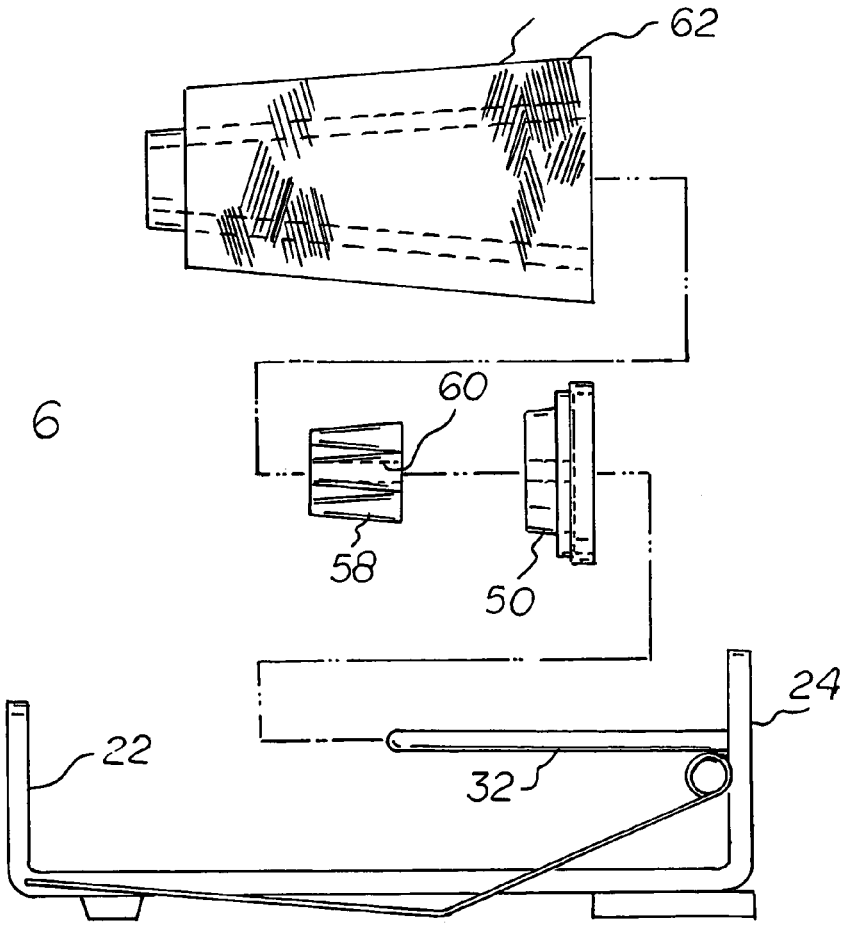
FIG. 6 is an exploded front elevational view of the embodiment shown in FIG. 5 but with the guide rod rotated into a stowed inoperative orientation.

Next provided are secondary retention components. Note FIGS. 5 and 6. The secondary retention components include a cone 58. The cone has a central cylindrical aperture 60 adapted to be frictionally supported on the rod. The cone also has a cone-shaped exterior surface for receiving a cone shaped spool 62 supporting threads 64. The secondary retention components also include the stepped disk 50. The cone-shaped spool on the rod is between the cone exteriorly and the stepped disk interiorly.

Figure 3A:
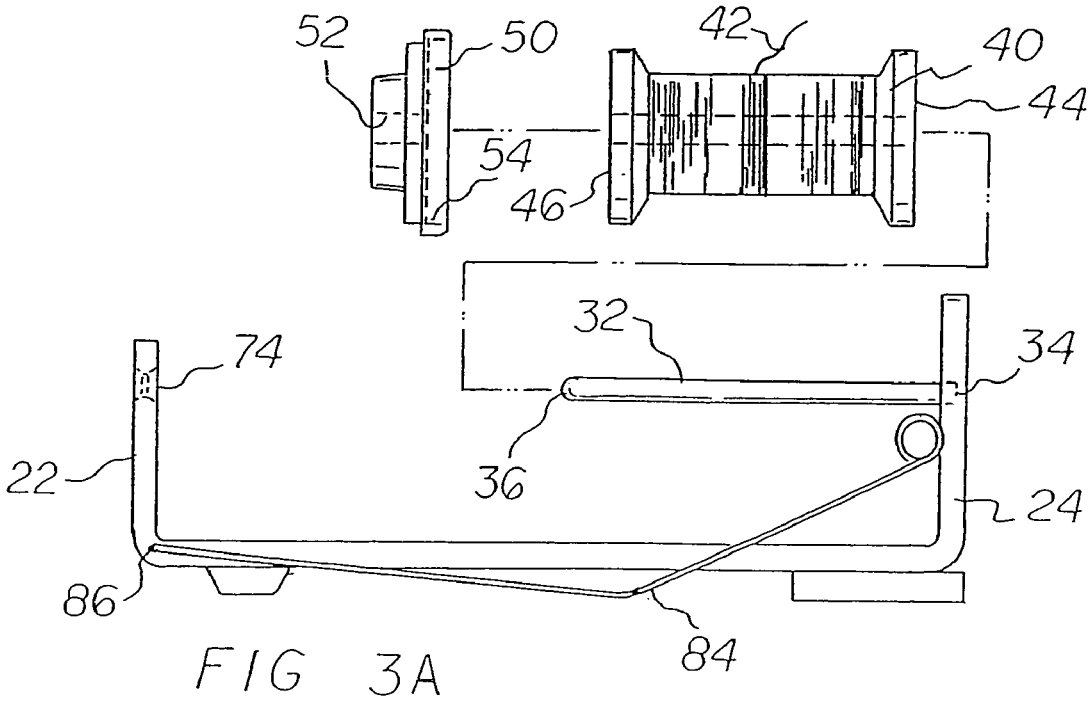
FIGS. 3A and 3B are exploded frong elevational views similar to FIG. 1 but illustrating alternate embodiments with larger and smaller spools, the guide rod being rotated into a stowed inoperative orientation.
Figure 3B:
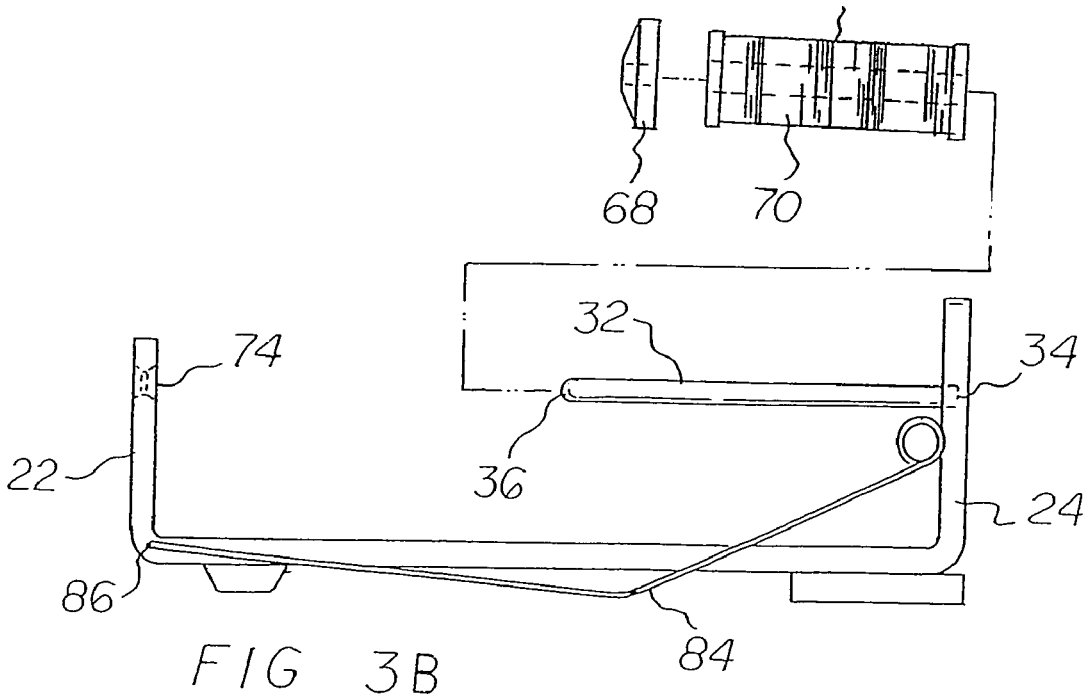

Next provided is a tertiary retention component. Note FIG. 3. The tertiary retention component includes a small disk 68 fabricated of a lubricious plastic material. The small disk has a central aperture adapted to be frictionally supported on the rod. A small spool 70 supports thread. The small disc rotatably supports the small spool on the rod.

Next provided is a cylindrical aperture 74 in the short leg axially aligned with the rod. The cylindrical aperture is adapted to receive and guide thread fed to a sewing machine from a spool.

Next provided is a guide rod 78 fabricated of a relatively stiff material, preferably a stiff metal wire. The guide rod has a looped end 80 and a short bent end 82 and an extended length 84 there between. A short recess 86 extends laterally into the base in proximity to the central extent and the short leg. The short recess frictionally supports the short bent end of the guide rod for rotation between a stowed inoperative orientation with the looped end in proximity to the long leg and an extended operative orientation with the looped end remote from the central extent and long leg of the base. The looped end receives and guides a thread from the aperture in the short leg and a sewing machine. The extended length has a bend 88 in a central extent of between about 120 and 150 degrees whereby the system is operable with the exterior face of the base on a recipient surface and in an alternate mode with the long leg on a recipient surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spool support system comprising:

a base including a central extent with a first leg and a second leg;

a cylindrical rod secured to the second leg with a free end facing toward the first leg;

a spool retention component supported on the rod with an interior end adapted to contact the spool;

a cylindrical aperture in the first leg axially aligned with the rod and adapted to receive and guide thread fed from a spool; and a guide rod fabricated of a relatively stiff material with a looped end and a short bent end, said base provided with a short recess adjacent to the first leg and the central extent of the base extending laterally into the base frictionally supporting the short bent end of the guide rod for rotation between an extended operative orientation with the looped end remote from the central extent and second leg of the base and a stowed inoperative orientation, the system being operable with the cylindrical rod in a horizontal orientation while supported on the central extent of the base and with the cylindrical rod in a vertical orientation while supported on the second leg.

2. The system as set forth in claim 1 wherein the retention component includes a stepped disk fabricated of a lubricious plastic material with a central aperture adapted to be frictionally supported on the rod with a stepped interior end adapted to receive an exterior flange of a spool for providing a friction abating surface for thread pulled from the spool during operation and use.

3. The system as set forth in claim 1 wherein the retention component includes a cone with a central cylindrical aperture adapted to be frictionally supported on the rod and a cone-shaped exterior surface for receiving a cone shaped spool supporting threads, the retention components also including a disk with a cone shaped spool on the rod between the cone exteriorly and the disk interiorly.

4. The system as set forth in claim 1 wherein the retention component includes a small disk fabricated of a lubricious plastic material with a central aperture adapted to be frictionally supported on the rod with a small spool having thread rotatably supported on the rod by the small disk.

5. A spool support system for feeding a thread from a spool comprising, in combination:

a base in a generally U-shaped configuration including a central extent with a planar exterior face and a parallel interior face, the interior face having a first end with a first leg extending perpendicularly from the first end and a second end with a second leg extending perpendicularly from the second end for supporting the system, the base also including a first spacer secured to the exterior face adjacent to the first end and a second spacer secured to the exterior face adjacent to the second end for supporting the system, the base being fabricated of a rigid plastic material;

a cylindrical rod having a fixed end rigidly secured to the second leg and a free end facing toward the first leg, the rod being parallel with the interior face of the central extent and fabricated of a rigid metal with a length of between about 40 and 60 percent of the length of the central extent;

a generally cylindrical spool with an interior cylindrical surface rotatably received on the rod and an exterior cylindrical surface supporting thread thereon, the spool including free axial ends with an interior flange and an exterior flange at the free axial ends thereof;

spool retention components including a stepped disk fabricated of a lubricious plastic material with a central aperture adapted to be frictionally supported on the rod and with the disk having a stepped interior end adapted to receive the exterior flange of the spool for providing a friction abating surface for thread pulled from the spool during operation and use;

a cylindrical aperture in the first leg axially aligned with the rod and adapted to receive and guide thread fed to a sewing machine from a spool; and a guide rod fabricated of a relatively stiff metal wire, the guide rod having a looped end and a short bent end and an extended length there between, with a short recess extending laterally into the base in proximity to the central extent and the first leg, the short recess frictionally supporting the short bent end of the guide rod for rotation between a stowed inoperative orientation with the looped end in proximity to the second leg and an extended operative orientation with the looped end remote from the central extent and second leg of the base, the looped end receiving and guiding a thread from the aperture in the first leg, the extended length having a bend in a central extent of between about 120 and 150 degrees whereby the system is operable with the exterior face of the base on a recipient surface and in an alternate mode with the second leg on a recipient surface.

* * * * *